US006613488B1

(12) United States Patent
Nakamura et al.

(10) Patent No.: US 6,613,488 B1
(45) Date of Patent: Sep. 2, 2003

(54) ELECTROPHOTOGRAPHIC PHOTOSENSITIVE MATERIAL, ELECTROPHOTOGRAPHIC PHOTOCONDUCTOR, AND METHOD FOR MANUFACTURING SAME

(75) Inventors: Yoichi Nakamura, Nagano (JP); Shinjirou Suzuki, Nagano (JP); Hideki Kina, Nagano (JP); Kenichi Hara, Nagano (JP); Teruo Sasaki, Nagano (JP)

(73) Assignee: Fuji Electric Imaging Devices Co., Ltd., Nagano (JP)

( * ) Notice: Subject to any disclaimer, the term of this patent is extended or adjusted under 35 U.S.C. 154(b) by 0 days.

(21) Appl. No.: 09/684,204

(22) Filed: Oct. 6, 2000

(30) Foreign Application Priority Data

Oct. 7, 1999 (JP) ..... 11-286426

(51) Int. Cl.[7] ..... G03G 5/06

(52) U.S. Cl. ..... 430/78; 430/59.4; 430/59.5; 430/135; 252/501.1; 540/140; 540/122

(58) Field of Search ..... 430/59.4, 59.5, 430/78, 135, 133; 252/501.1; 540/122, 140

(56) References Cited

U.S. PATENT DOCUMENTS 5,563,014 A * 10/1996 Malhotra et al. ..... 430/56
6,197,103 B1 * 3/2001 Davies et al. ..... 106/410

FOREIGN PATENT DOCUMENTS

JP 58211161 A * 12/1983

OTHER PUBLICATIONS

Chemical Abstracts 100:219015.*

Borsenberger, Paul M & David S. Weiss. Organic Photoreceptors for Imaging Systems. New York: Marcel–Dekker, Inc. pp. 338–361. (1993).*

Diamond, Arthur S. Handbook of Imaging Materials. New York: Marcel–Dekker, Inc. pp. 329–331. (1991).*

* cited by examiner

*Primary Examiner*—Christopher Rodee

(57) ABSTRACT

A phthalimide salt compound is contained in a photosensitive material having a charge generating function. Such a photosensitive material exhibits high retention rates of the surface charge. An electrophotographic photoconductor comprising such a photosensitive material is useful in, for example, printers, photocopiers, and facsmilie machines.

16 Claims, 1 Drawing Sheet

ELECTROPHOTOGRAPHIC PHOTOSENSITIVE MATERIAL, ELECTROPHOTOGRAPHIC PHOTOCONDUCTOR, AND METHOD FOR MANUFACTURING SAME

TECHNICAL FIELD OF THE INVENTION

The present invention relates to electrophotographic photosensitive materials employed in electrophotographic photoconductors which are used in electrophotographic apparatuses, such as printers, copiers and facsimile machines. The present invention further relates to methods for manufacturing these electrophotographic photosensitive materials and electrophotograhpic photoconductors.

In particular, the invention relates to such photosensitive material and photoconductors that exhibit excellent surface charge retention rate by the use of an improved additive, and to the manufacturing methods of such material and photoconductors.

BACKGROUND OF THE INVENTION

Electrophotographic photoconductors are required to maintain surface charges in the dark, generate charges upon receipt of light, and transport charges upon receipt of light. Conventional photoconductors include a so-called single-layer type photoconductor having these functions in a single layer, as well as so-called function separated laminated layer type photoconductor, having a layer that mainly serves to generate charges with a layer that serves to maintain surface charges in the dark and to transport charges upon receipt of light.

These conventional photoconductors are used for forming images by known electrophotographic methods, such as the Carlson method. The image formation of this method is performed by charging the photoconductor by a corona discharge in the dark, forming an electrostatic latent image, such as characters or drawings of an original, on the charged surface of the photoconductor, developing the thus formed electrostatic image by means of toner powder, transferring and fixing the toner powder representing the image onto a support, such as paper. After the toner transfer, the residual toner powder is removed, and residual charges are erased by light exposure, so that the photoconductor can be used again.

Several types of photosensitive material for the electrophotographic photoconductor there have been used. Typical materials include selenium, selenium alloys, inorganic photoconductive substances, such as zinc oxide and cadmium oxide, dispersed in a resin binder, as well as organic photoconductive substances, such as poly-N-vinylcarbazole, 9,10-anthracenediole polyester, hydrazone, stylbene, butadiene, benzidine, phthalocyanine or bisazo compound, dispersed in a resin binder or subjected to vacuum deposition or sublimation, for example.

Although utilization of a phthalimide salt in electrophotographic technology is disclosed in Japanese Unexamined Patent Application Publication Nos. S58-211161, H2-272461 and H4-294368, and U.S. Pat. Nos. 5,514,505 and 5,563,014, these references relate only to toners or to agents for giving transparency.

As described above, numerous researches have been made on the electrophotographic photosensitive material, electrophotographic photoconductors, and the methods for manufacturing thereof. However, satisfactory retention rate of surface charge has not yet been achieved.

OBJECTS AND SUMMARY OF THE INVENTION

It is an object of the presetn invention to provide an electrophotographic photosensitve material that overcomes the foregoing problems.

More specifically, it is an object of the present invention to provide electrophotographic photosensitive material that exhibits excellent surface charge retention rate.

It is a further object of the present invention to provide an electrophotographic photoconductor including such photosensitive material.

It is another object of the present invetion to provide a method for manufacturing such photosensitive material and for manufacturing such a photoconductor.

The present invention has been made by studying influence of phthalimide salt to electrophotographic properties. The inventors of the present invention have made numerous researches to solve the foregoing problems. It has been found that the surface charge retention rate is substantially improved when a phthalimide salt compound is contained in electrophotographic photosensitive material capable of charge generating function or in a photosensitive layer of a photoconductor including a charge generating substance. The present invention has been accomplished according to this finding.

Therefore, an electrophotographic photosensitive material of the invention capable of charge generation is characterized by containment of phthalimide salt compound therein.

An electrophotographic photoconductor of the invention comprises an electrically conductive substrate and a photosensitive layer including a charge generation substance on the substrate. The photosensitive layer contains a phthalimide salt compound.

A method of the invention for manufacturing electrophotographic photosensitive material includes a step for adding a phthalimide compound to a charge generation substance or a step for generating a phthalimide salt compound by treating a phthalocyanine compound with a basic compound.

A method of the invention for manufacturing an electrophotographic photoconductor comprises a step for forming a photosensitive layer by coating an electrically conductive substrate with coating liquid including electrophotographic photosensitive material that contains a phthalimide salt compound.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1 (*b*) is a schematic cross sectional view illustrating an embodiment of single-layer type photoconductor of the present invention.

DETAILED DESCRIPTION OF THE PRESENT INVENTION

The invention will be described in greater detail with reference to preferred embodiments thereof and the accompanying drawings.

There are several types of conventional electrophotographic photoconductors, such as a negative-charging laminated-layer type photoconductor, a positive-charging laminated-layer type photoconductor, and a positive-charging single-layer type photoconductor. While the following describes a negative-charging laminated-layer type photoconductor as an example in detail, material and method for forming and manufacturing a photoconductor of the invention may be appropriately selected from any known material and methods, except for material and methods relating to a phthalimide salt compound.

Figure 1A:
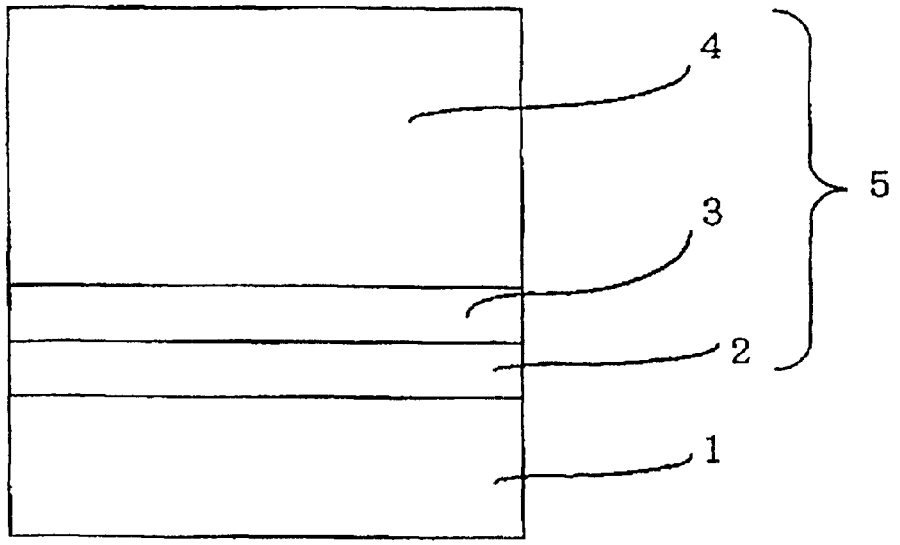
FIG. 1(*a*) is a schematic cross sectional view illustrating an embodiment of a function-separated laminated-layer type photoconductor of the present invention.
Figure 1B:
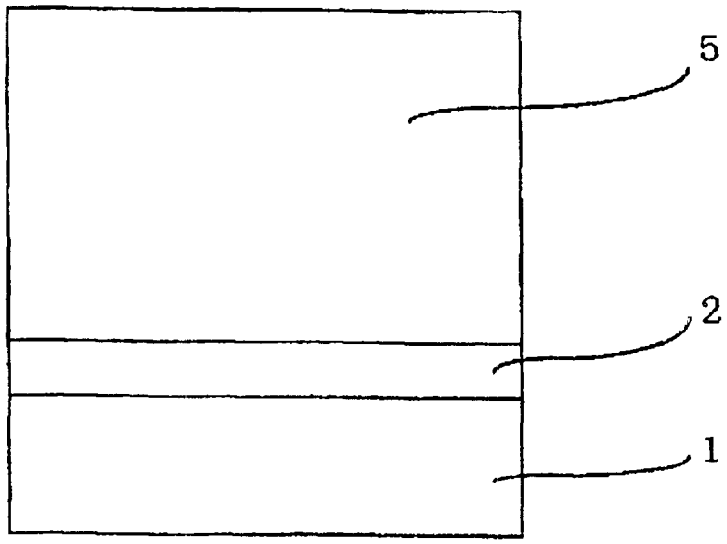

Referring to FIGS. 1(*a*) and 1(*b*), the negative-charging laminated-layer type photoconductor shown in FIG. 1(*a*) comprises an electrically conductive substrate 1 having an undercoat layer 2 thereon. A photosensitive layer 5, including a charge generation layer 3 capable of charge generation and charge transport layer 4 capable of charge transport, is laminated on undercoat layer 2. The positive-charging single-layer type photoconductor shown in FIG. 1(*b*) comprises an electrically conductive substrate 1 having an undercoat layer 2 thereon. A single-layer photosensitive layer 5, capable of both charge generation and charge transport, is laminated on undercoat layer 2. Undercoat layer 2 is not necessarily provided in the both types of photoconductors. Photosensitive layer 5 contains charge transport agent that transports charges upon receipt of light.

Electrically conductive substrate 1 functions as an electrode of the photoconductor, as well as a support for the other layers. Conductive substrate 1 may have a cylindrical shape, a planer shape, or a film shape, and may be formed of a metal, such as aluminum, stainless steel or nickel, or glass or resin treated to be given a certain conductivity.

Undercoat layer 2 may be formed of alcohol-soluble polyamide, solvent-soluble aromatic polyamide, or thermosetting urethane resin. The alcohol-soluble polyamide may be preferably a polymer or a copolymer, such as nylon 6, nylon 8, nylon 12, nylon 66, nylon 610, or nylon 612, or N-alkyl-modified- or N-alkoxyalkyl-modified-nylon. The specific material of the above-compounds may be AMILAN CM8000 (a 6/66/610/12 copolymerized nylon available from Toray Industries Inc.), ELBAMIDE 9061 (a 6/66/612 copolymerized nylon available from Du Pont Japan Co., Ltd.), and DAIAMIDE T-170 (a copolymerized nylon mainly composed of nylon 12, available from Daicel-Huels Co., Ltd.).

Undercoat layer 2 may further include inorganic fine particles, such as $TiO_2$, alumina, calcium carbonate, or silica.

Charge generation layer 3, which generates charges upon receipt of light, is formed by depositing particles of charge generating substance on undercoat layer 2, or by coating undercoat layer 2 with coating liquid in which charge generating substance is dispersed in a solvent with a resin binder. It is important for charge generation layer 3 to have a high ability of injecting the generated charges into charge transport layer 4, as well as high efficiency of charge generation. Namely, it is desirable that charge generation layer 3 generates charges with less dependence on electric field and have excellent capability of charge generation even in a low electric field.

The charge generation substance may be selected from various pigments and dyes, such as phthalocyanine, azo, quinone, indigo, cyanine, squarilium, and azulenium compounds.

The film thickness of charge generation layer 3 is determined by light absorption coefficient of its charge generation substance. Thus, the thickness of charge generation layer 3 is preferably controlled to be not greater than 5 $\mu$m, more preferably, not greater than 1 $\mu$m.

Charge generation layer 3 contains charge generating substance as a major component, to which charge transport substance and other material may be added. The resin binder used in charge generation layer 3 may be selected from polymers and copolymers of polycarbonate, polyester, polyamide, polyurethane, epoxy, poly(vinyl butyral), phenoxy, silicone, methacrylate, vinyl chloride, ketal and vinyl acetate, and halogenated compounds and cyanoethyl compounds of these substances, which may be used in suitable combination. The charge generating substance used in the charge generation layer is contained preferably in an amount of 10 to 5000 parts by weight, more preferably 50 to 1000 parts by weight with respect to 100 parts by weight of the resin binder.

Charge transport layer 4 is a coating film formed of material dissolving charge transport substance in a resin binder. The charge transport substance may be selected from hydrazone compounds, styryl compounds, amine compounds, and their derivatives, alone or in suitable combination, for example. Charge transport layer 4 serves as an insulating layer in the dark for retaining charges of the photoconductor, and functions to transport charges injected from the charge generation layer upon receipt of light. The binder resin used in the charge transport layer may be selected from polymers and copolymers of polycarbonate, polyester, polystyrene, and methacrylate, for example. It is important that the resin binder is selected considering compatibility with the charge transport substance, as well as the mechanical, chemical and electrical stability and adhesiveness. The charge transport substance is contained preferably in an amount of 20 to 500 parts by weight, more preferably, 30 to 300 parts by weight with respect to 100 parts by weight of the resin binder.

The film thickness of the charge transport layer 4 is preferably controlled in a range of 3 to 50 $\mu$m, more preferably 15 to 40 $\mu$m, so as to maintain a practically effective surface potential.

The phthalimide salt compound to be contained in the photosensitive material or in the photoconductor of the invention may be preferably selected from ammonium phthalimide represented by Chemical Formula (I), sodium phthalimide represented by Chemical Formula (II), potassium phthalimide represented by Chemical Formula (III), phthalimide-1,8-diazabicyclo[5.4.0]-7-undecene represented by Chemical Formula (IV) (abbreviated to phthalimide DBU), and phthalimide-1,5-diazabicyclo[4.3.0]-5-nonene represented by Chemical Formula (V) (abbreviated to phthalimide DBN), for example.

(I)

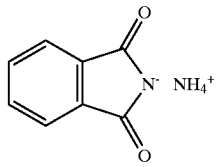

(II)

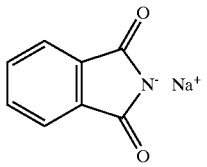

-continued (III)

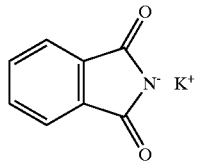

(IV)

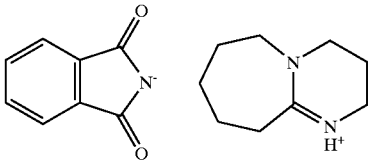

(V)

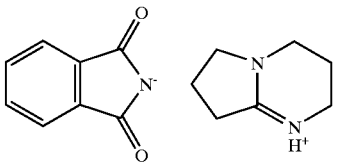

The phthalimide salt compound may be used selecting from commercially available ones, or synthesized according to the references herein incorporated by reference, including: Ronald E. Macleay, et al., U.S. Pat. No. 4,218,370; David E. Bergbreiter, et al., *J Polym. Sci., Part A: Polym. Chem.* 27(12), 4205 (1989), and Alan J. Fischman, et al., *J Am. Chem. Soc.*, 100(1), 54 (1978).

Alternatively, the phthalimide salt compound may be generated by decomposition of a phthalocyanine compound using a basic compound.

The amount of the phthalimide salt compound to be used in the preferred embodiment of the invention is appropriately controlled depending on the required electrophotographic characteristic. The preferred amount of the phthalimide salt compound is in a range of from about 0.000001 to about 5 wt %, more preferably, 0.00001 to 1 wt % with respect to the amount of the photosensitive material capable of charge generation.

While not holding to a particular theory, a mechanism for the substantial increase in the retention rate by containment of the phthalimide salt compound according to the invention can be considered as follows. That is, the phthalimide salt compound is supposed to moderately inhibit crystal growth of the photosensitive material which has a function to generate charges, while to improve dispersion of the crystals. This may be considered to lead to the improvement of the retention rate.

The photosensitive layer containing the phthalimide salt compound according to the invention may be comprised by both single-layer type and laminated-layer type photoconductors, and is not limited to any one of the two types.

The coating liquid in a manufacturing method of the invention may be applied by means of any coating method selected from various methods including dip-coating and spray-coating, for example, and does not limited to any special coating method.

EXAMPLES

Synthesis Example 1

Initially, 600 g of o-phthalodinitrile (manufactured by Tokyo Chemical Industry Co., Ltd.), 300 g of formamide (manufactured by Kanto Kagaku Co., Ltd.), 100 g of sodium methoxide (manufactured by Kanto Kagaku Co., Ltd.), and 1.0 liter of N-methyl-2-pyrrolidinone (manufactured by Kanto Kagaku Co., Ltd.) were put into a reaction vessel and stirred in a nitrogen atmosphere. The resulting mixture was warmed to 180° C. and stirred for 15 hrs.

The reacted liquid was cooled to 130° C., filtered, and washed with 3 liter of N-methyl-2-pyrrolidinone. The resulting wet cake was heated and stirred in 1 liter of N-methyl-2-pyrrolidinone at 120° C. for 1 hr in a nitrogen atmosphere. The resulting mixture was cooled, filtered, and sequentially washed with 3 liter of N-methyl-2-pyrrolidinone, 1 liter of acetone and 4 liter of warm pure water to obtain a wet cake.

The resulting wet cake was heated and stirred at 80° C. for 1 hr in diluted hydrochloric acid prepared with 360 ml of 36% hydrochloric acid and 4 liter of water, cooled, filtered, washed with 4 liter of warm pure water, and dried to obtain an unrefined form of metal-free phthalocyanine.

Subsequently, 200 g of the obtained metal-free phthalocyanine was added to 4 kg of 96% sulfuric acid at −5° C. while being cooled and stirred so that the liquid temperature was kept at below −5° C. The liquid was further stirred for 1 hr being at −5° C. The resulting sulfuric acid solution was added to 35 liter of water and 5 kg of ice, and stirred and cooled for 1 hr at below 10° C. The liquid was filtered and washed with 10 liter of warm water to obtain a wet cake.

The wet cake was mixed with diluted hydrochloric acid consisting of 10 liter of water and 770 ml of 36% hydrochloric acid, and heated and stirred at 80° C. for 1 hr. The resulting liquid was cooled, filtered, and washed with 10 liter of warm water to obtain a wet cake.

The resulting wet cake and 1.5 liter of o-dichlorobenzene were milled by a ball-mill. The resulting article was extracted with 1.5 liter of acetone and 1.5 liter of methanol, filtered, washed with 1.5 liter of pure water, and dried to obtain power material.

Finally, 0.000001 wt % of ammonium phthalimide, which was manufactured referring to the above-cited references, was added to and mixed with the above-obtained powder material. Thus, metal-free phthalocyanine was produced.

Synthesis Example 2

Metal-free phthalocyanine was produced in the same manner as in Synthesis Example 1 except that the quantity of the ammonium phthalimide was changed to 0.001 wt %.

Synthesis Example 3

Metal-free phthalocyanine was produced in the same manner as in Synthesis Example 1 except that the quantity of the ammonium phthalimide was changed to 5 wt %.

Synthesis Example 4

Metal-free phthalocyanine was produced in the same manner as in Synthesis Example 1 except that the ammonium phthalimide was replaced by sodium phthalimide, which was manufactured referring to the references cited earlier.

Synthesis Example 5

Metal-free phthalocyanine was produced in the same manner as in Synthesis Example 2 except that the ammonium phthalimide was replaced by sodium phthalimide, which was manufactured referring to the references cited earlier.

Synthesis Example 6

Metal-free phthalocyanine was produced in the same manner as in Synthesis Example 3 except that the ammonium phthalimide was replaced by sodium phthalimide, which was manufactured referring to the references cited earlier.

Synthesis Example 7

Metal-free phthalocyanine was produced in the same manner as in Synthesis Example 1 except that the ammonium phthalimide was replaced by phthalimide DBU manufactured by Sigma-Aldrich Co.

Synthesis Example 8

Metal-free phthalocyanine was produced in the same manner as in Synthesis Example 2 except that the ammonium phthalimide was replaced by phthalimide DBU manufactured by Sigma-Aldrich Co.

Synthesis Example 9

Metal-free phthalocyanine was produced in the same manner as in Synthesis Example 3 except that the ammonium phthalimide was replaced by phthalimide DBU manufactured by Sigma-Aldrich Co.

Synthesis Example 10

Initially, 600 g of o-phthalodinitrile, 300 g of formamide, 100 g of sodium methoxide, and 1.0 liter of N-methyl-2-pyrrolidinone were put into a reaction vessel and stirred in a nitrogen atmosphere, The resulting mixture was warmed to 180° C. and stirred at that temperature for 15 hrs.

The reacted liquid was cooled to 130° C., filtered, and washed with 3 liter of N-methyl-2-pyrrolidinone. The resulting wet cake was heated and stirred in 1 liter of N-methyl-2-pyrrolidinone at 120° C. for 1 hr in a nitrogen atmosphere. The resulting mixture was cooled, filtered, and then sequencially washed with 3 liter of N-methyl-2-pyrrolidinone, 1 liter of acetone and 4 liter of warm pure water to obtain a wet cake.

The resulting wet cake was heated to 80° C. and stirred for 1 hr in diluted hydrochloric acid prepared with 360 ml of 36% hydrochloric acid and 4 liter of water, cooled, filtered, washed with 4 liter of warm pure water, and dried to obtain an refined form of metal-free phthalocyanine.

Subsequently, 200 g of the obtained metal-free phthalocyanine was added to 4 kg of 96% sulfuric acid at −5° C. while being cooled and stirred so that the liquid temperature was kept at below −5° C. The liquid was further stirred for 1 hr at below −5° C. The resulting sulfuric acid solution was added to 35 liter of water and 5 kg of ice, and stirred and cooled for 1 hr being held at below 10° C. The liquid was filtered and washed with 10 liter of warm water to obtain a wet cake.

The wet cake was mixed with diluted hydrochloric acid consisting of 10 liter of water and 770 ml of 36% hydrochloric acid, heated to 80° C., and stirred for 1 hr. The resulting liquid was cooled, filtered, and washed with 10 liter of warm water to obtain a wet cake.

The wet cake was mixed with a sodium hydroxide solution consisting of 10 liter of water and 1000 g of sodium hydroxide, heated to 80° C., and stirred for 1 hr. The resulting liquid was cooled, filtered, and washed with 10 liter of warm pure water to obtain a wet cake.

The wet cake and 1.5 liter of o-dichlorobenzene were milled by a ball-mill. The resulted article was extracted with 1.5 liter of acetone and 1.5 liter of methanol, filtered, washed with 1.5 liter of pure water, and dried. Thus, metal-free phthalocyanine was produced.

The resulting metal-free phthalocyanine was subjected to the ion chromatography analysis. The analysis showed that the metal-free phthalocyanine contained 0.02 wt % of ammonium phthalimide.

Comparative Synthesis Example 1

Metal-free phthalocyanine was produced in the same manner as in Synthesis Example 1 except that ammonium phthalimide used in Synthesis Example 1 was not added.

Synthesis Example 11

Initially, 800 g of o-phthalodinitrile and 1.8 liter of quinoline (manufactured by Kanto Chemical Co., Ltd.) were stirred in a reaction vessel. Subsequently, 297 g of titanium tetrachloride (manufactured by Kishida Chemical Co., Ltd.) was added dropwise and stirred in a nitrogen atmosphere. The resulting mixture was heated and stirred at 180° C. for 15 hrs.

The reacted liquid was cooled to 130° C., filtered, and washed with 3 liter of N-methyl-2-pyrrolidinone. The resulting wet cake was heated and stirred in 1.8 liter of N-methyl-2-pyrrolidinone at 160° C. for 1 hr in a nitrogen atmosphere. The resulting mixture was cooled, filtered, and then sequencially washed with 3 liter of N-methyl-2-pyrrolidinone, 2 liter of acetone, 2 liter of methanol, and 4 liter of warm water in this order, to obtain a wet cake.

The resulting wet cake was heated and stirred at 80° C. for 1 hr in diluted hydrochloric acid consisting of 360 ml of 36% hydrochloric acid and 4 liter of water, cooled, filtered, washed with 4 liter of warm water, and dried, to obtain an unrefined form of titanyloxyphthalocyanine.

Subsequently, 200 g of the obtained titanyloxyphthalocyanine was added to 4 kg of 96% sulfuric acid at −5° C. while being cooled and stirred so that the liquid temperature was kept below −5° C. The liquid was further stirred and cooled for 1 hr at −5° C. The resulting sulfuric acid solution was added to 35 liter of water and 5 kg of ice. This resulting mixture was stirred and cooled to below 10° C. for 1 hr. The liquid was filtered and washed with 10 liter of warm water to obtain a wet cake.

The wet cake was mixed with diluted hydrochloric acid consisting of 10 liter of water and 770 ml of 36% hydrochloric acid, heated to 80° C., and stirred for 1 hr. The resulting liquid was allowed to cool, filtered, and washed with 10 liter of warm water to obtain a wet cake.

The resulting wet cake and 1.5 liter of o-dichlorobenzene were milled by a ball-mill. The resulted article was extracted with 1.5 liter of acetone and 1.5 liter of methanol, filtered, washed with 1.5 liter of pure water, and dried to obtain powder material.

Finally, 0.000001 wt % of ammonium phthalimide was added to and mixed with the above-obtained powder material. Thus, titanyloxyphthalocyanine was produced.

Synthesis Example 12

Titanyloxyphthalocyanine was produced in the same manner as in Synthesis Example 11 except that the quantity of the ammonium phthalimide was changed to 0.001 wt %.

Synthesis Example 13

Titanyloxyphthalocyanine was produced in the same manner as in Synthesis Example 11 except that the quantity of the ammonium phthalimide was changed to 5 wt %.

Synthesis Example 14

Titanyloxyphthalocyanine was produced in the same manner as in Synthesis Example 11 except that the ammonium phthalimide was replaced by sodium phthalimide.

Synthesis Example 15

Titanyloxyphthalocyanine was produced in the same manner as in Synthesis Example 12 except that the ammonium phthalimide was replaced by sodium phthalimide.

Synthesis Example 16

Titanyloxyphthalocyanine was produced in the same manner as in Synthesis Example 13 except that the ammonium phthalimide was replaced by sodium phthalimide.

Synthesis Example 17

Titanyloxyphthalocyanine was produced in the same manner as in Synthesis Example 11 except that the ammonium phthalimide was replaced by phthalimide DBU.

Synthesis Example 18

Titanyloxyphthalocyanine was produced in the same manner as in Synthesis Example 12 except that the ammonium phthalimide was replaced by phthalimide DBU.

Synthesis Example 19

Titanyloxyphthalocyanine was produced in the same manner as in Synthesis Example 13 except that the ammonium phthalimide was replaced by phthalimide DBU.

Synthesis Example 20

Initially, 800 g of o-phthalodinitrile and 1.8 liter of quinoline (manufactured by Kanto Chemical Co., Ltd.) were stilled in a reaction vessel. Subsequently, 297 g of titanium tetrachloride (manufactured by Kishida Chemical Co., Ltd.) was added dropwise and stirred in a nitrogen atmosphere. The resulting mixture was heated and stirred at 180° C. for 15 hrs.

The reacted liquid was cooled to 130° C., filtered, and washed with 3 liter of N-methyl-2-pyrrolidinone. The resulting wet cake was heated and stirred in 1.8 liter of N-methyl-2-pyrrolidinone at 160° C. for 1 hr in a nitrogen atmosphere. The resulting mixture was cooled, filtered, and then sequencially washed with 3 liter of N-methyl-2-pyrrolidinone, 2 liter of acetone, 2 liter of methanol, and 4 liter of warm water in this order, to obtain a wet cake.

The resulting obtained wet cake was heated to 80° C. and stirred for 1 hr in diluted hydrochloric acid consisting of 360 ml of 36% hydrochloric acid and 4 liter of water, cooled, filtered, washed with 4 liter of warm water, and dried, to obtain an unrefined form of titanyloxyphthalocyanine.

Subsequently, 200 g of the obtained titanyloxyphthalocyanine was added to 4 kg of 96% sulfuric acid at −5° C. while being cooled and stirred so that the liquid temperature was kept below −5° C. The liquid was further stirred and cooled for 1 hr at −5° C. The resulting sulfuric acid solution was added to 35 liter of water and 5 kg of ice. The resulting mixture was stirred and cooled for 1 hr being held below 10 ° C. The liquid was filtered and washed with 10 liter of warm water to obtain a wet cake.

The wet cake was mixed with diluted hydrochloric acid consisting of 10 liter of water and 770 ml of 36% hydrochloric acid, heated to 80° C., and stirred for 1 hr. The resulting liquid was allowed to cool down, filtered, and washed with 10 liter of warm water to obtain a wet cake.

The wet cake was mixed with a sodium hydroxide solution consisting of 10 liter of water and 1000 g of sodium hydroxide, heated to 80° C., and stirred for 1 hr. The resulting liquid was allowed to cool down, filtered, and washed with 10 liter of warm pure water to obtain a wet cake.

The resulting wet cake and 1.5 liter of o-dichlorobenzene were milled by a ball-mill. The resulting article was extracted with 1.5 liter of acetone and 1.5 liter of methanol, filtered, washed with 1.5 liter of pure water, and dried. Thus, titanyloxyphthalocyanine was produced.

The obtained titanyloxyphthalocyanine was subjected to the ion chromatography analysis. The analysis showed that the metal-free phthalocyanine contained 0.03 wt % of ammonium phthalimide.

Comparative Synthesis Example 2

Titanyloxyphthalocyanine was produced in the same manner as in Synthesis Example 11 except that ammonium phthalimide used in Synthesis Example 11 was not added.

Example 1

A coating liquid for an undercoat layer was produced by mixing 70 parts by weight of a polyamide resin (CM8000 available from Toray Industries, Inc.) and 930 parts by weight of methanol. An aluminum substrate was coated with the coating liquid by dip-coating method, and dried to form an undercoat layer having a thickness of 0.5 $\mu$m.

A coating liquid for a charge generation layer was produced by ultrasonically dispersing a mixture of 20 parts by weight of metal-free phthalocyanine manufactured by Synthesis Example 1, 676 parts by weight of dichloromethane, 294 parts by weight of 1,2-dichloroethane, and 10 parts by weight of a vinyl chloride resin (MR-110 available from Nippon Zeon Co., Ltd.). The substrate coated with the undercoat layer was coated with the coating liquid by dip-coating method and dried to form a charge generation layer having a thickness of 0.2$\mu$m.

A coating liquid for a charge transport layer was produced by mixing 100 parts by weight of 4-(diphenylamino) benzaldehyde phenyl (2-thienylmethyl) hydrazone (manufactured by Fuji Electric Co., Ltd.), 100 parts by weight of a polycarbonate resin(PANLITE K-1300 available from Teijin Chemical Co., Ltd.), 800 parts by weight of dichloromethane, 1 part by weight of a silane coupling agent (KP-340 available from Shin'etsu Chemical Co., Ltd.), and 4 parts by weight of 2,4-di-tert-butyl phenoxy diphenylphosphine (manufactured by Fuji Electric Co., Ltd.). The substrate coated with the charge generation layer was coated with the coating liquid by dip-coating method and dried to form a charge transport layer having a thickness of 20 $\mu$m. Thus, a photoconductor was fabricated.

Example 2

A photoconductor was fabricated in the same manner as in Example 1 except that the coating liquid for the charge generation layer was produced using the metal-free phthalocyanine manufactured by Synthesis Example 2 in place of metal-free phthalocyanine manufactured by Synthesis Example 1.

Example 3

A photoconductor was fabricated in the same manner as in Example 1 except that the coating liquid for the charge generation layer was produced using the metal-free phthalocyanine manufactured by Synthesis Example 3 in place of metal-free phthalocyanine manufactured by Synthesis Example 1.

Example 4

A photoconductor was fabricated in the same manner as in Example 1 except that the coating liquid for the charge generation layer was produced using the metal-free phthalocyanine manufactured by Synthesis Example 4 in place of metal-free phthalocyanine manufactured by Synthesis Example 1.

Example 5

A photoconductor was fabricated in the same manner as in Example 1 except that the coating liquid for the charge generation layer was produced using the metal-free phthalocyanine manufactured by Synthesis Example 5 in place of metal-free phthalocyanine manufactured by Synthesis Example 1.

Example 6

A photoconductor was fabricated in the same manner as in Example 1 except that the coating liquid for the charge generation layer was produced using the metal-free phthalocyanine manufactured by Synthesis Example 6 in place of metal-free phthalocyanine manufactured by Synthesis Example 1.

Example 7

A photoconductor was fabricated in the same manner as in Example 1 except that the coating liquid for the charge generation layer was produced using the metal-free phthalocyanine manufactured by Synthesis Example 7 in place of metal-free phthalocyanine manufactured by Synthesis Example 1.

Example 8

A photoconductor was fabricated in the same manner as in Example 1 except that the coating liquid for the charge generation layer was produced using the metal-free phthalocyanine manufactured by Synthesis Example 8 in place of metal-free phthalocyanine manufactured by Synthesis Example 1.

Example 9

A photoconductor was fabricated in the same manner as in Example 1 except that the coating liquid for the charge generation layer was produced using the metal-free phthalocyanine manufactured by Synthesis Example 9 in place of metal-free phthalocyanine manufactured by Synthesis Example 1.

Example 10

A photoconductor was fabricated in the same manner as in Example 1 except that the coating liquid for the charge generation layer was produced using the metal-free phthalocyanine manufactured by Synthesis Example 10 in place of metal-free phthalocyanine manufactured by Synthesis Example 1.

Comparative Example 1

A photoconductor was fabricated in the same manner as in Example 1 except that the coating liquid for the charge generation layer was produced using the metal-free phthalocyanine manufactured by Comparative Synthesis Example 1 in place of metal-free phthalocyanine manufactured by Synthesis Example 1.

Example 11

A coating liquid for an undercoat layer was produced by mixing 70 parts by weight of a polyamide resin (CM8000 available from Toray Industries, Inc.) and 930 parts by weight of methanol. An aluminum substrate was coated with the coating liquid by dip-coating method and dried to form an undercoat layer having a thickness of 0.5 $\mu$m.

A coating liquid for a charge generation layer was produced by ultrasonically dispersing a mixture of 20 parts by weight of titanyloxyphthalocyanine manufactured by Synthesis Example 11, 676 parts by weight of dichloromethane, 294 parts by weight of 1,2-dichloroethane, and 10 parts by weight of a vinyl chloride resin (MR-110 available from Nippon Zeon Co., Ltd.). The substrate coated with the undercoat layer was coated with the coating liquid by dip-coating method and dried to form a charge generation layer having a thickness of 0.2 $\mu$m.

A coating liquid for a charge transport layer was produced by mixing 100 parts by weight of 4-(diphenylamino) benzaldehyde phenyl (2-thienylmethyl) hydrazone (manufactured by Fuji Electric Co., Ltd.), 100 parts by weight of a polycarbonate resin (PANLITE K-1300 available from Teijin Chemical Co., Ltd.), 800 parts by weight of dichloromethane, 1 parts by weight of a silane coupling agent (KP-340 available from Shin'etsu Chemical Co., Ltd.), and 4 parts by weight of 2,4-di-tert-butyl phenoxy diphenylphosphine (manufactured by Fuji Electric Co., Ltd.). The substrate coated with the charge generation layer was coated with the coating liquid by dip-coating method and dried to form a charge transport layer having a thickness of 20 $\mu$m. Thus, a photoconductor was fabricated.

Example 12

A photoconductor was fabricated in the same manner as in Example 11 except that the coating liquid for the charge generation layer was produced using the titanyloxyphthalocyanine manufactured by Synthesis Example 12 in place of titanyloxyphthalocyanine manufactured by Synthesis Example 11.

Example 13

A photoconductor was fabricated in the same manner as in Example 11 except that the coating liquid for the charge generation layer was produced using the titanyloxyphthalocyanine manufactured by Synthesis Example 13 in place of titanyloxyphthalocyanine manufactured by Synthesis Example 11.

Example 14

A photoconductor was fabricated in the same manner as in Example 11 except that the coating liquid for the charge generation layer was produced using the titanyloxyphthalocyanine manufactured by Synthesis Example 14 in place of titanyloxyphthalocyanine manufactured by Synthesis Example 11.

Example 15

A photoconductor was fabricated in the same manner as in Example 11 except that the coating liquid for the charge generation layer was produced using the titanyloxyphthalocyanine manufactured by Synthesis Example 15 in place of titanyloxyphthalocyanine manufactured by Synthesis Example 11.

Example 16

A photoconductor was fabricated in the same manner as in Example 11 except that the coating liquid for the charge generation layer was produced using the titanyloxyphthalocyanine manufactured by Synthesis Example 16 in place of titanyloxyphthalocyanine manufactured by Synthesis Example 11.

Example 17

A photoconductor was fabricated in the same manner as in Example 11 except that the coating liquid for the charge generation layer was produced using the titanyloxyphthalocyanine manufactured by Synthesis Example 17 in place of titanyloxyphthalocyanine manufactured by Synthesis Example 11.

Example 18

A photoconductor was fabricated in the same manner as in Example 11 except that the coating liquid for the charge generation layer was produced using the titanyloxyphthalocyanine manufactured by Synthesis Example 18 in place of titanyloxyphthalocyanine manufactured by Synthesis Example 11.

Example 19

A photoconductor was fabricated in the same manner as in Example 11 except that the coating liquid for the charge generation layer was produced using the titanyloxyphthalocyanine manufactured by Synthesis Example 19 in place of titanyloxyphthalocyanine manufactured by Synthesis Example 11.

Example 20

A photoconductor was fabricated in the same manner as in Example 11 except that the coating liquid for the charge generation layer was produced using the titanyloxyphthalocyanine manufactured by Synthesis Example 20 in place of titanyloxyphthalocyanine manufactured by Synthesis Example 11.

Comparative Example 2

A photoconductor was fabricated in the same manner as in Example 11 except that the coating liquid for the charge generation layer was produced using the titanyloxyphthalocyanine manufactured by Comparative Synthesis Example 2 in place of titanyloxyphthalocyanine manufactured by Synthesis Example 11.

The electric characteristics of the photoconductor of each of Examples 1 through 20 and Comparative Examples 1 and 2 were measured using an electrostatic recording paper test apparatus (EPA-8200 manufactured by Kawaguchi Electric Works Co., Ltd.).

The surface of each photoconductor was negatively charged in the dark by a corona discharge at −5 kV for 10 seconds. Subsequently, the retention rate of the surface charge in 5 seconds was measured.

Table 1 shows the retention rate of the surface charge after 5 seconds for each sample of the photoconductors.

TABLE 1

| sample | charge retention rate after 5 seconds (%) |
|---|---|
| Example 1 | 97.6 |
| Example 2 | 97.9 |
| Example 3 | 97.5 |
| Example 4 | 97.9 |
| Example 5 | 98.1 |
| Example 6 | 98.0 |
| Example 7 | 97.4 |
| Example 8 | 97.5 |
| Example 9 | 97.4 |
| Example 10 | 97.8 |
| Comparative Example 1 | 87.4 |
| Example 11 | 96.7 |
| Example 12 | 96.8 |
| Example 13 | 96.5 |
| Example 14 | 97.0 |
| Example 15 | 97.2 |
| Example 16 | 96.9 |
| Example 17 | 96.2 |
| Example 18 | 96.3 |
| Example 18 | 96.0 |
| Example 20 | 96.6 |
| Comparative Example 2 | 86.5 |

As is apparent in Table 1, all of the Examples exhibit large values of the retention rate of the surface charge after 5 seconds and revealed excellent charge retention characteristic, while Comparative Examples showed less values of the retention rate.

Effect of the Invention

The electrophotographic photosensitive material having a charge generating function to which a phthalimide salt compound is added according to the present invention exhibits high retention rate of the surface charge.

The electrophotographic photoconductor comprising a conductive substrate and a photosensitive layer including charge generating substance, in which a phthalimnide salt compound is added in the photosensitive layer according to the present invention, exhibits high retention rate of the surface charge.

The method for manufacturing an electrophotographic photoconductor comprising a conductive substrate and a photosensitive layer, in which the photosensitive layer is formed by coating the conductive substrate with a coating liquid including electrophotographic photosensitive material that contains a phthalimide salt compound according to the present invention, provides a photoconductor exhibiting high retention rate of the surface charge.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electrophotographic photosensitive material for generating electric charges wherein said photosensitive material comprises a phthalocyanine compound that contains a phthalimide salt compound, and wherein said phthalocyanine compound is a metal-free phthalocyanine compound or a titanyloxyphthalocyanine compound.

2. An electrophotographic photosensitive material as claimed in claim 1, wherein said phthalimide salt compound is an ammonium phthalimide compound.

3. An electrophotographic photosensitive material as claimed in claim 1, wherein said phthalimide salt compound is a sodium phthalimide compound.

4. An electrophotographic photosensitive material as claimed in claim 1, wherein said phthalimide salt compound is a potassium phthalimide compound.

5. An electrophotographic photosensitive material for generating electric charge, wherein said photsensitive material comprises a metal-free phthalcyanine compound that contains a phthalimide salt compound.

6. An electrophotographic photosensitive material for generating electric charge, wherein said photosensitive material comprises a titanyloxyphthalocyanine compound that contains a phthalimide salt compound.

7. An electrophotographic photoconductor, comprising:

an electrically conductive substrate; and a photosensitive layer having a charge generating substance that contains a phthalimide salt compound, wherein said phthalimide salt compound is selected from the group consisting of an ammonium phthalimide compound, a sodium phthalimide compound, and a potassium phthalimide compound.

8. An electrophotographic photoconductor as claimed in claim 7 wherein said phthalimide salt compound is an ammonium phthalimide compound.

9. An electrophotographic photoconductor as claimed in claim 7, wherein the charge generating substance is a phthalocyanine compound that contains said phthalimide salt compound.

10. An electrophotographic photoconductor as claimed in claim 7, wherein said charge generating substance is a metal-free phthalocyanine compound that contains a phthalimide salt compound.

11. An electrophotographic photoconductor as claimed in claim 7, wherein said charge generating substance is a titanyloxyphthalocyanine compound that contains a phthalimide salt compound.

12. An electrophotographic photoconductor as claimed in claim 10, wherein said phthalimide salt compound is a sodium phthalimide compound.

13. An electrophotographic photoconductor as claimed in claim 7, wherein said phthalimide salt compound is a potassium phthalimide compound.

14. A method for manufacturing an electrophotographic photosensitive material having a charge generating substance, comprising forming a phthalocyanine compound that contains a phthalimide salt compound, wherein said phthalocyanine compound is a metal-free phthalocyanine compound or a titanyloxyphthalocyanine compound.

15. The method of claim 14, wherein the phthalocyanine compound is treated with a basic compound to form a phthalimide salt compound.

16. A method for manufacturing an electrophotographic photoconductor comprising: coating a conductive substrate with a liquid to form a photosensitive layer wherein said coating liquid comprises a photosensitive material; wherein said photosensitive material includes a phthalimide salt compound, and wherein said phthalimide salt compound is selected from the group consisting of an ammonium phthalimide compound, a sodium phthalimide compound, and a potassium phthalimide compound.

* * * * *

UNITED STATES PATENT AND TRADEMARK OFFICE

CERTIFICATE OF CORRECTION

PATENT NO. : 6,613,488 B1
DATED : September 2, 2003
INVENTOR(S) : Yoichi Nakamura et al.

It is certified that error appears in the above-identified patent and that said Letters Patent is hereby corrected as shown below:

Title page,
Item [73], Assignee, please delete "Fuji Electric Imaging Devices Co., Ltd.," and substitute -- Fuji Electric Imaging Device Co., Ltd. --

Signed and Sealed this

Ninth Day of March, 2004

JON W. DUDAS
*Acting Director of the United States Patent and Trademark Office*